US005228901A

United States Patent [19]

Taylor et al.

[11] Patent Number: 5,228,901

[45] Date of Patent: Jul. 20, 1993

[54] PARTIAL REDUCTION OF PARTICULATE IRON ORES AND CYCLONE REACTOR

[75] Inventors: Patrick R. Taylor; Robert W. Bartlett; Masud Abdel-Latif, all of Moscow, Id.

[73] Assignee: Idaho Research Foundation, Inc., Moscow, Id.

[21] Appl. No.: 660,778

[22] Filed: Feb. 25, 1991

[51] Int. Cl.[5] ..... C21B 13/12

[52] U.S. Cl. ..... 75/453; 75/10.22; 266/182

[58] Field of Search ..... 75/453, 10.22; 266/182

[56] References Cited

U.S. PATENT DOCUMENTS

| | | | |
|---|---|---|---|
| 2,184,300 | 12/1939 | Hodson et al. . | |
| 2,530,078 | 11/1950 | Ramsing . | |
| 2,745,734 | 5/1956 | Oster . | |
| 2,745,737 | 5/1956 | Oster . | |
| 2,846,300 | 8/1958 | Wenzel . | |
| 2,973,260 | 2/1961 | Nogiwa . | |
| 3,421,884 | 1/1969 | Pfeiffer et al. . | |
| 3,607,224 | 9/1971 | Blaskowski . | |
| 4,849,015 | 7/1989 | Fassbinder et al. | 75/453 |
| 4,851,039 | 7/1989 | Papst et al. | 75/453 |
| 4,976,776 | 12/1990 | Elvander et al. | 75/453 |

OTHER PUBLICATIONS

Chem Abstracts 113:8247w 1990.
Chem Abstracts 113:101213d 1990.
Chem Abstracts 113:101214e 1990.
"Flash Melting and Partial Reduction of Iron Ore Concentrates," by Robert W. Bartlett, published in Salt Lake City, Ut. in 1988 at the Center for Pyrometallurgy Symposium.
Chem Abstracts 113:82472u 1990.
Chem Abstracts 113:82473v 1990.

*Primary Examiner*—Melvyn J. Andrews
*Attorney, Agent, or Firm*—Wells, St. John, Roberts, Gregory & Matkin

[57] ABSTRACT

A closed-cover hot cyclone reactor is used to melt and partially reduce particulate iron or ferro-alloy ores fed to it in a stream. Tangential streams of fuel gas or, preferably, producer gas supplied by an associated bath smelter, interact with the spiralling particles as they pass through the reactor. The molten metal travels downwardly along the reactor walls and can be discharged by gravity onto the receiving bath. The system eliminates the need for pelletizing ore and coking coal in smelting of iron products.

15 Claims, 8 Drawing Sheets

PARTIAL REDUCTION OF PARTICULATE IRON ORES AND CYCLONE REACTOR

TECHNICAL FIELD

This disclosure pertains to smelting of iron or ferro-alloy ores. More specifically, it pertains to an improvement in the equipment and methods utilized in preparing such ores for introduction into bath smelting systems.

BACKGROUND OF THE INVENTION

The present disclosure pertains to a new apparatus and method for partial pre-reduction of iron or ferro-alloy ores, using fine particulate ores and fuel gas or coal-based producer gas in a hot cyclone reactor. The producer gas is preferably derived from the off gas resulting from operation of a bath smelting process. The melted and partially reduced iron that exits the hot cyclone reactor can then be gravity-coupled to a bath smelting process for complete reduction of ore to liquid iron or steel.

The disclosed apparatus and process obviates the need for indurated iron or ferro-alloy ore pellets. It also eliminates the need for coking of the coal used in the disclosed processes.

Both environmental and economic considerations have led to renewed efforts to develop effective iron smelting processes and equipment utilizing coal, rather than coke. Among the current coal-based systems under consideration are bath smelting processes. The background of bath smelting processes and their perceived shortcomings are described in a paper titled "Flash Melting and Partial Reduction of Iron Ore Concentrates" by Robert W. Bartlett, published in Salt Lake City, Utah in 1988 at the Center for Pyrometallurgy Symposium. That paper is hereby incorporated into this application by reference.

The referenced paper describes efforts to evaluate improvements in bath smelting processes for iron ores by flash melting particulate ores as they are descending to the bath. To do this, the ore particles are injected with a carrier gas and allowed to react with the bath off-gases as they rise between the bath and injector.

Partial reduction of iron oxide particles is initiated as the ore particles are delivered to the bath. This occurs in a quasi-counter current system in which the rising reducing gases flow by the descending ore particles. The difficulties perceived in this system revolved about the very short free flight residence time of the particles, which particularly limited pre-smelting reduction of larger ore particles.

The principle of cyclone firing entered practical boiler construction in the nineteen forties. The appeal of the cyclone configuration is that it gives flash combustion efficiency through turbulence enhanced mass and heat transfer and reaction rates. Pyrometallurgical processes using cyclones were first suggested in the mid-1950's, when a plant was built in Sardina to treat antimony concentrates. Another early use was developed in the USSR for copper concentrates.

As mentioned in the referenced paper, high temperature entrained flow smelting (e.g. cyclone smelting) has been suggested as an alternative to bath smelting to use pulverized coal and dry iron ore concentrate. The application of cyclones to iron ore reduction was first attempted in 1955. The research was not successful and was terminated in 1966.

The ability to produce iron through the use of fine particulate ores and coal as starting materials is significant due to: the phase-out of coke ovens and the environmental costs associated with coking, the need for a coal-based iron process, the existence of a large amounts of fine taconite, and the fact that a process based upon treating fine particles would be more economic because pelletizing and pellet induration would not be required.

The presently-described use of a cyclone reactor to partially reduce iron ore fines pores a number of advantages, for example: utilization of waste producer gas from the primary smelting furnace, high throughout being possible in a small reactor, enhanced heat and mass transfer rates, increased mixing of particles and gases due to high turbulence, use of high reaction temperatures, rapid reaction times available when dealing with small particles, elimination of induration, the use of coal in place of coke, and rapid separation of liquids and gases.

BRIEF DESCRIPTION OF THE DRAWINGS

The preferred embodiment of the invention is illustrated in the accompanying drawings, in which:

FIG. 4 is a plot of time for complete reaction as a function of the ratio of CO to $CO_2$;

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

The disclosed cyclone reactor according to this disclosure is lined with non-reactive refractory material. It can be effectively operated at temperatures in excess of 1400° C. (typically 1500° C.) and encompasses a reducing atmosphere. Fine particulate ores, such as a taconite concentrate or a ferro-alloy ore, and either a fuel gas or a producer gas (mostly carbon monoxide and carbon dioxide), or both, are fed tangentially into the cyclone. When desired, a stream of particulate coal might also be used as the primary or supplementary fuel for the reactor.

Fine particulate ore, such as taconite, can be melted and reduced to iron, wustite and some iron carbides during its residence time in the cyclone reactor. The resulting molten product is discharged from the bottom of the cyclone, where it can flow directly into an iron smelting bath. If desired the reactor can be uncoupled from and operated independently of the bath smelter.

The production process that occurs within the cyclone reactor preferably burns oxygen or oxygen-enriched air with excess quantities of CO rich producer gas to provide the required reaction heat while maintaining an adequately reducing chemical potential in the combustion gases. The producer gas used within the cyclone reactor will typically be the off-gas from the bath smelting furnace associated with the reactor.

Figure 1:
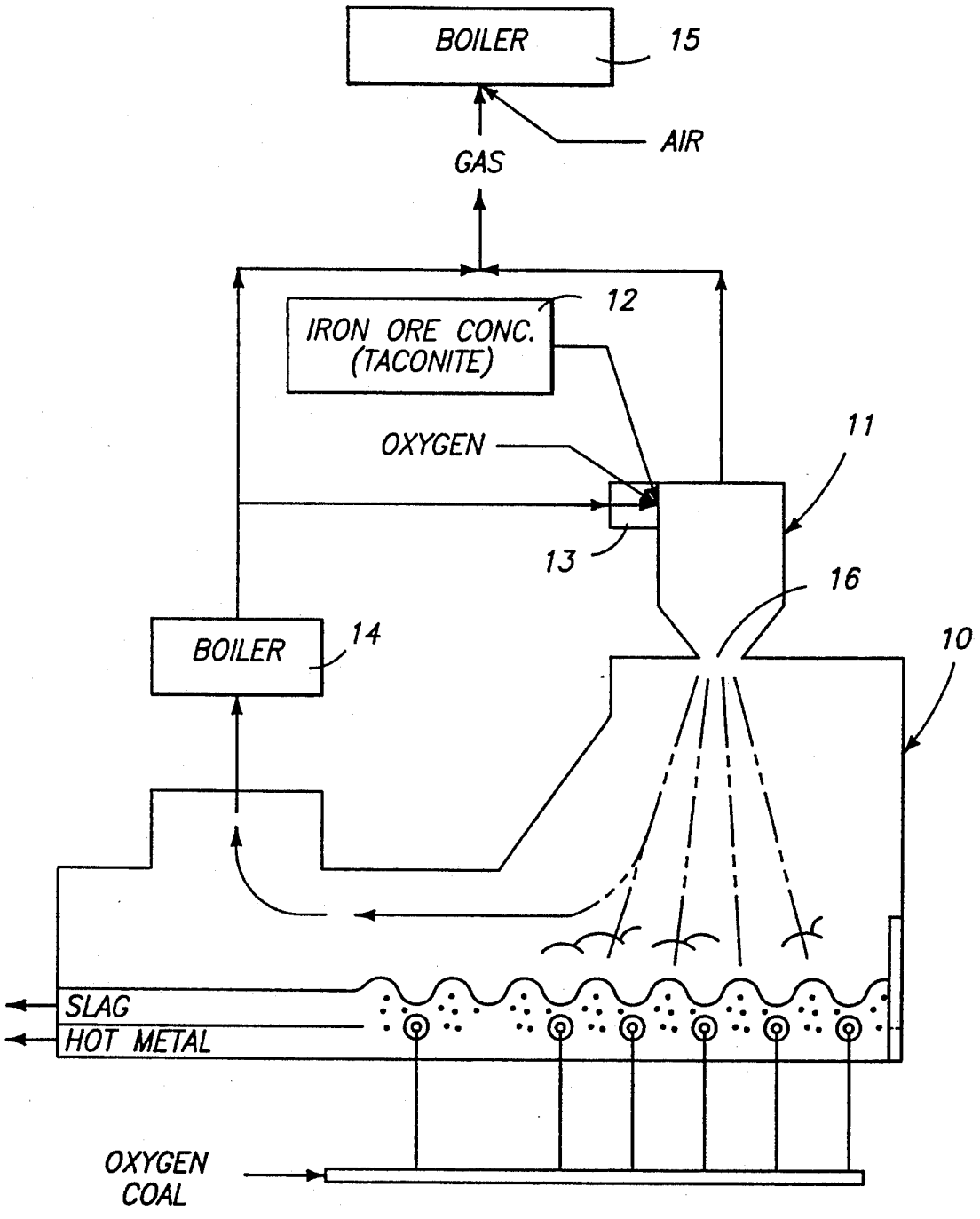
FIG. 1 is a diagrammatic view of the present system.

The apparatus and method are generally illustrated in FIG. 1. A conventional bath smelter is shown at 10. Coal and oxygen are injected into the molten metal reaction zone for direct-reduction purposes. Slag and hot metal are separated as shown to the left in FIG. 1, and the resulting off-gases are typically discharged for heat-recovery or cogeneration purposes.

In most bath smelting processes, the incoming ores are formed into pellets fed continuously into the bath smelter 10. The production of such ores initially requires that they be ground to a fine state prior to the pelletizing step. One object of this disclosure is to utilize the finely ground particulate ores without the costs and energy requirements of pelletizing.

In the present apparatus, the particulate iron or ferro-alloy ores are melted and partially reduced prior to introduction into the bath smelter 10. This is accomplished within a cyclone reactor 11. Feed means 12 is provided for directing a stream of fine ore particles into the cyclone reactor 11.

An external burner 13 can be used to direct a tangential stream of burning gases into the upper end of the cyclone reactor 11. These gases will normally comprise oxygen or oxygen-enriched air and waste producer gas from the bath smelter 10. Fuel gases, such as methane or natural gas, can be used in place of all or part of the producer gas when desired. The waste producer gas must first be cooled within a boiler 14 or other heat exchanger to lower its temperature to the handling temperature required for introduction into the cyclone reactor 11. Excess off-gas can be directed to a boiler 15 for combustion or for cogeneration purposes.

It is to be understood that the reducing gas or fuel material and the oxygen/air supply can be separately introduced into the cyclone reactor 11 in tangential streams by use of two or more injector nozzles (not shown) for this purpose. Additionally, an ignitor (not shown) must be provided to initiate burning when the cyclone reactor is being brought up to an equilibrium operating temperature. Once burning has been achieve, the system will be continuously operated and the gases will combust as they are introduced.

As diagrammatically shown in FIG. 1 the preferable location of the cyclone reactor 11 is immediately above the reaction zone within the bath smelter 10. The cyclone reactor is shown as a closed-top reactor having an open conical exit 16 positioned above the smelting bath within the bath smelter 10. The melted and partially reduced ore will collect about the conical walls of the cyclone reactor 11 and fall by gravity into the bath. At the preferred reaction temperatures, the melted ore will be preheated to the bath temperatures within the bath smelter 10, thereby contributing to higher efficiency of bath smelter operation.

Testing and calculations to date have shown that partial reduction of fine particulate iron or ferro-alloy ores is practical for a full scale refractory-lined cyclone reactor that is gravity-coupled to a bath smelter system. Typical particle residence times in the cyclone can range up to 10 seconds. Equilibrium temperatures within it can range between 1300°–1650° C. The system can effectively handle particle sizes below 150 microns.

THERMODYNAMIC ANALYSIS

Figure 2:
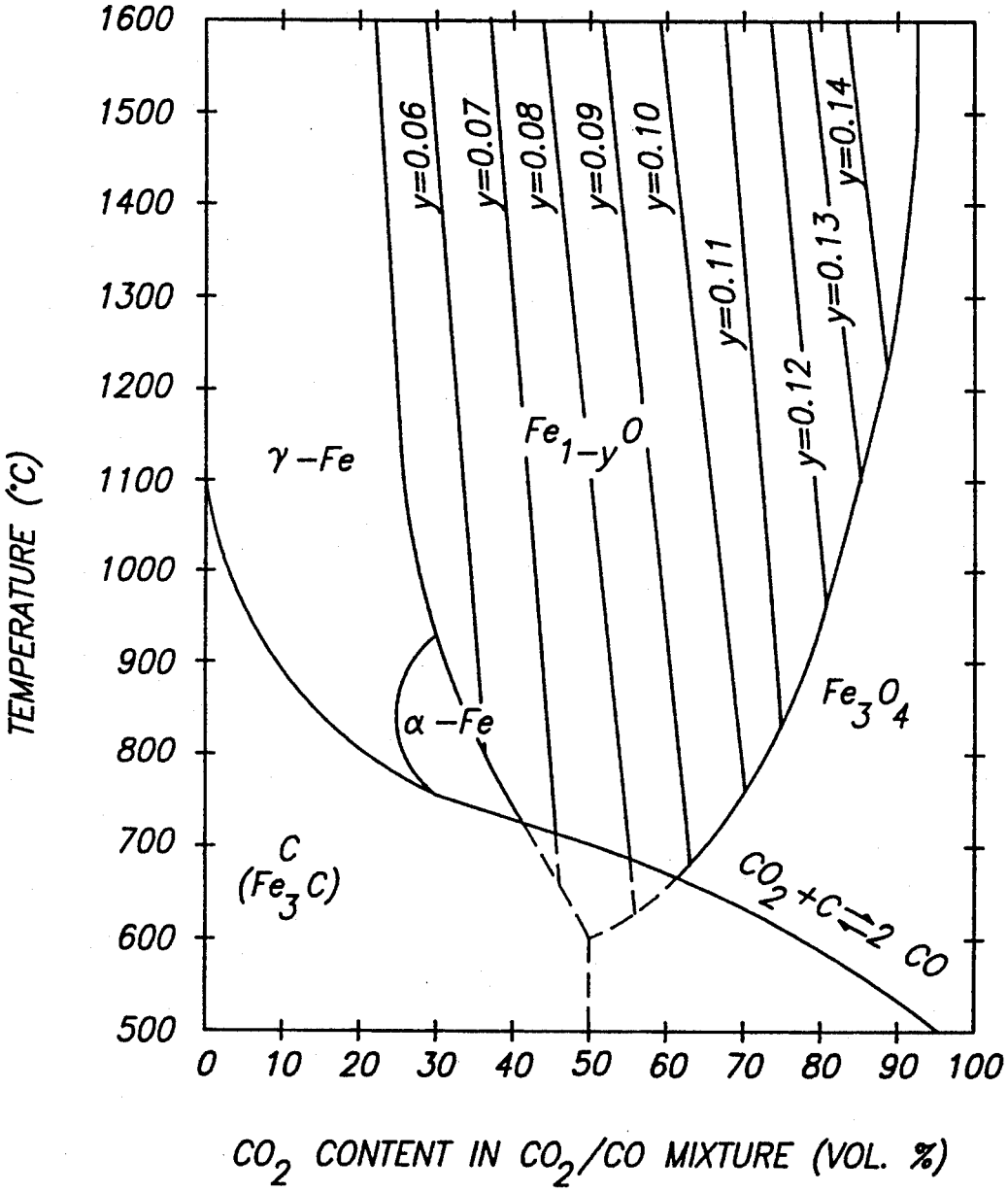
FIG. 2 is an equilibrium diagram plotting iron content as a function of temperature and $CO_2$ content in the exiting mixture.

The ability to reduce iron-based ores at high temperatures depends upon the equilibrium partial pressure ratio of carbon monoxide to carbon dioxide at the exit end of the cyclone reactor 11. This relationship for iron ores, such as taconite, is shown in FIG. 2. It shows equilibria between iron, wustite, magnetite and carbon monoxide, carbon dioxide and carbon at $P_{CO}+P_{CO_2}=1$ bar. As one example, at an average reactor temperature of 1500° C. (1773° K.) and an exit carbon monoxide to carbon dioxide partial pressure ratio of 1 (50% $CO_2$, the product would be mostly molten wustite (melting point = 1378° C. (1651° K.)). The volume ratio of $CO_2$ to CO and the equilibrium temperature at the exit end of the reactor can be chosen at any combination of values encompassing the wustite regions shown in FIG. 2 or those iron regions to the left of them.

The molten wustite and/or iron produced in the cyclone reactor 11 will collect certain impurities, such as: sulfur, carbon, etc. The solubilities of these impurities in the molten phases have been evaluated preliminarily. Experiments have confirmed that such impurities might be contained in the molten product leaving the cyclone reactor.

KINETIC CONSIDERATIONS

The rates at which suspended ore particles are reacted, heated, and melted may be estimated using transport models for the individual particles, assuming average gas compositions and temperatures.

Figure 3:
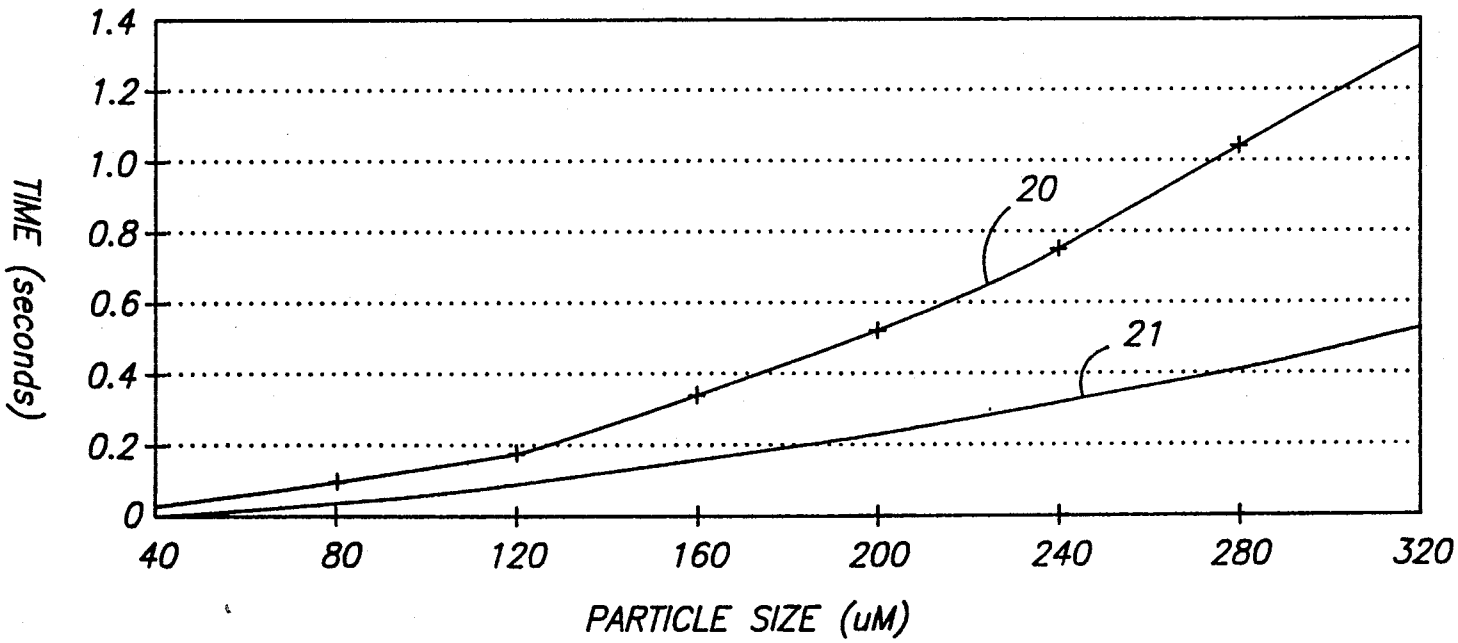
FIG. 3 PRIOR ART
FIG. 3 is a prior art depiction of a plot of time for complete reaction as a function of particle size.
Figure 11:
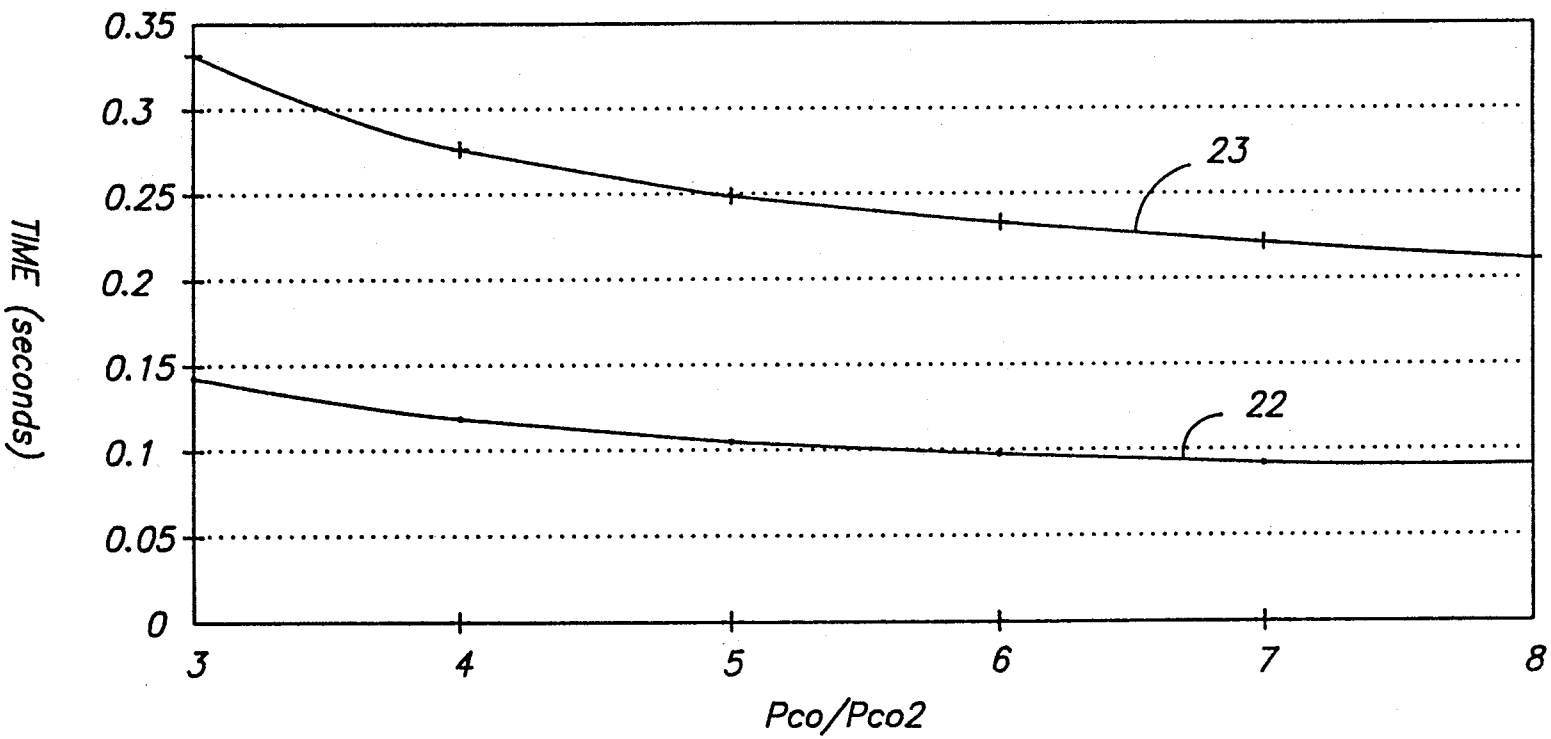

The rate of the reduction reaction is assumed to be controlled by either fluid film mass transfer or pore diffusion of the carbon monoxide. The time required for complete reaction of the magnetite particles, as a function of their size is shown in FIG. 3. The time values for fluid film mass transfer are illustrated by plotted line 20. The time values for pore diffusion control are illustrated by plotted line 21.

Similarly, the time for complete reaction is shown in FIG. 4 as a function of the carbon monoxide to carbon dioxide partial pressure ratio. Values for fluid film control are plotted along line 22, while values for pore diffusion control are plotted along line 23.

Figure 5:
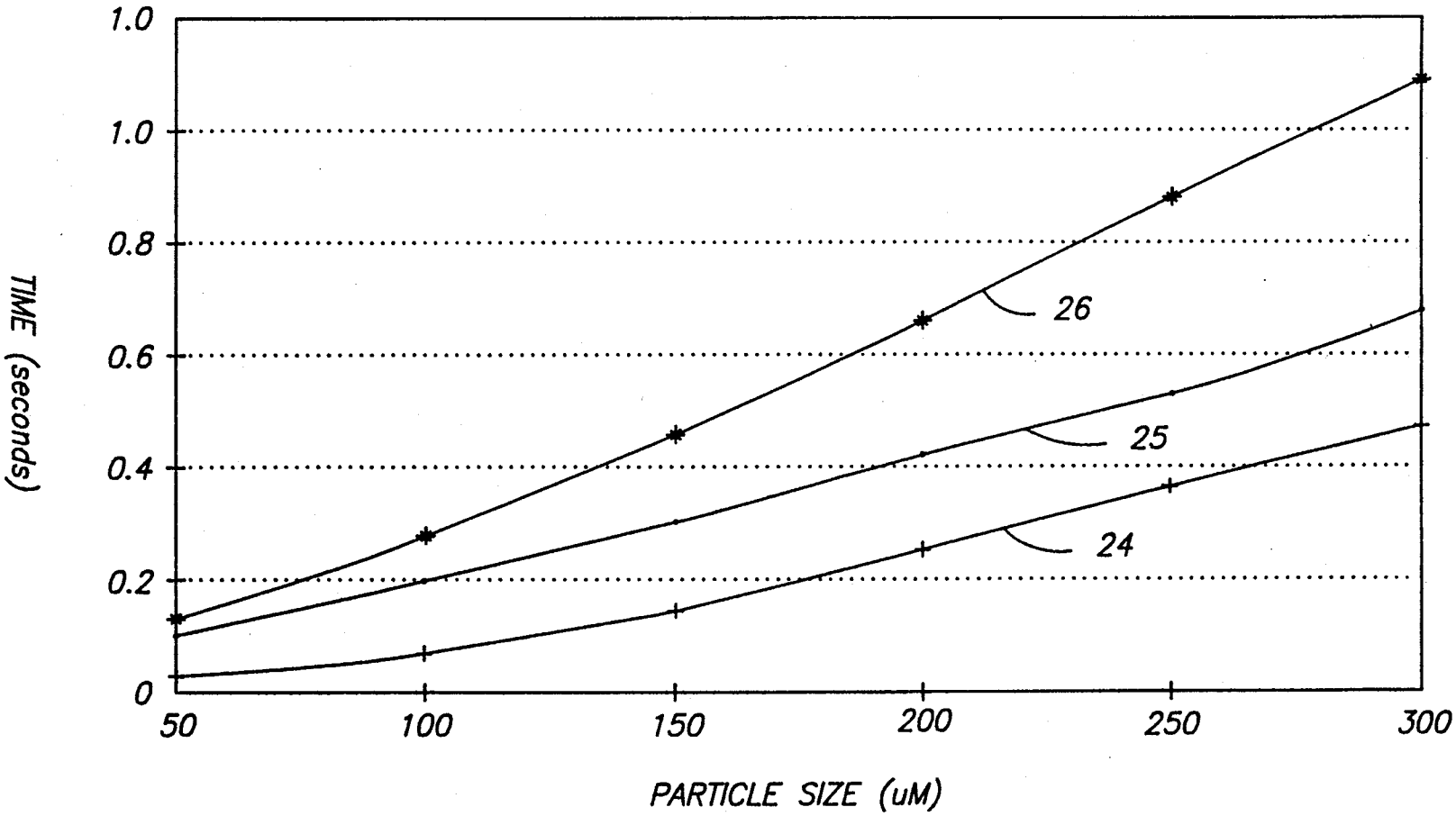
FIG. 5 is a plot of time for heating and melting as a function of particle size.
Figure 6:
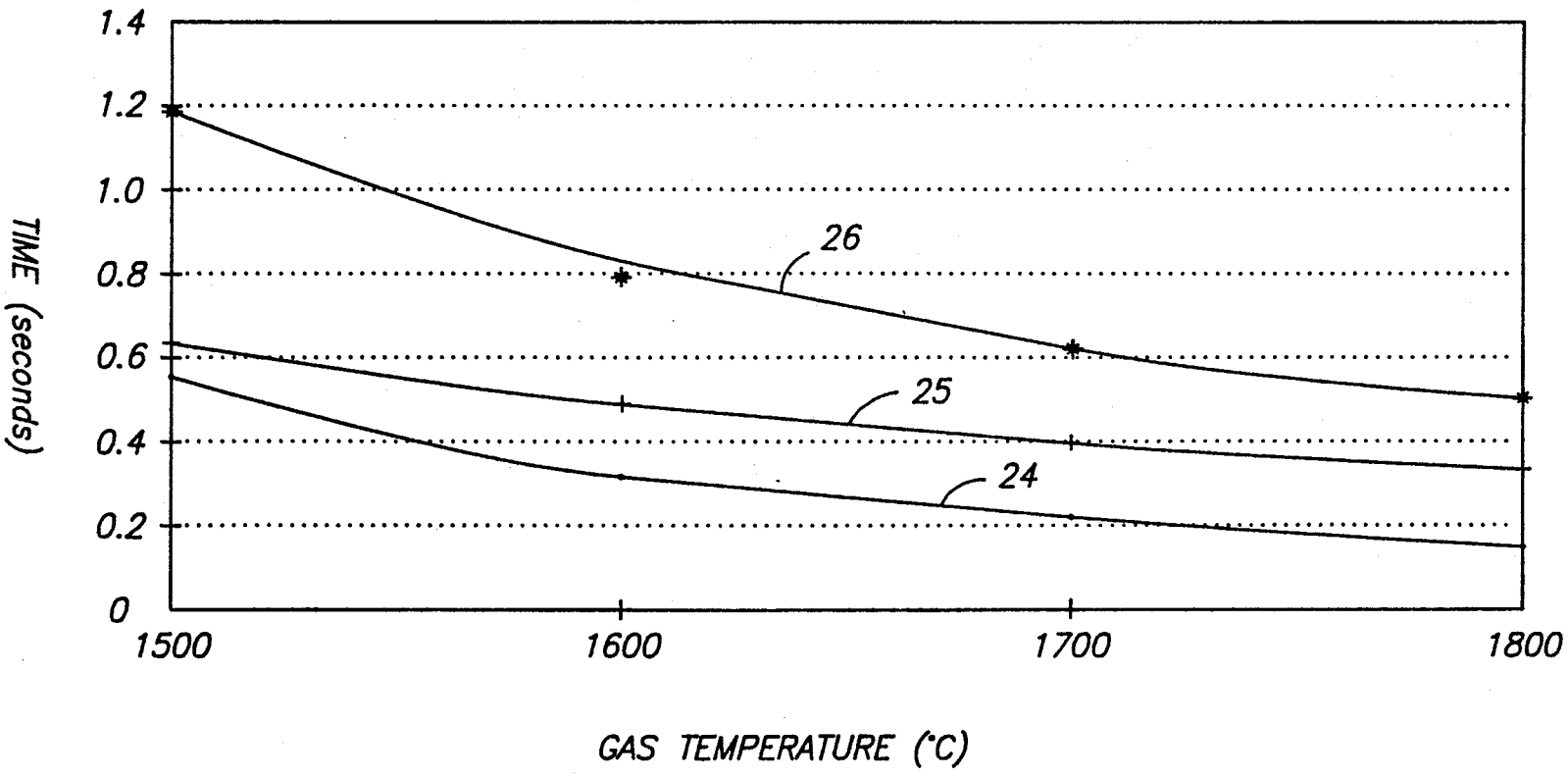
FIG. 6 is a plot of time for heating and melting as a function of gas temperature for 160 micron particles.

The rates of heating and melting of iron ore particles can also be calculated as functions of temperature and particle size. The heat loss to the cyclone reactor walls can also be estimated, using basic energy transport equations. The rate of heat loss depends primarily upon the wall heat transfer coefficient, wall emissivity, available surface area, and the wall temperature. Predicted rates are shown in FIGS. 5 and 6, as functions of temperature and size, respectively. In these plots, line 24 shows time to heat, line 25 shows time to melt, and line 26 shows total time.

Figure 7:
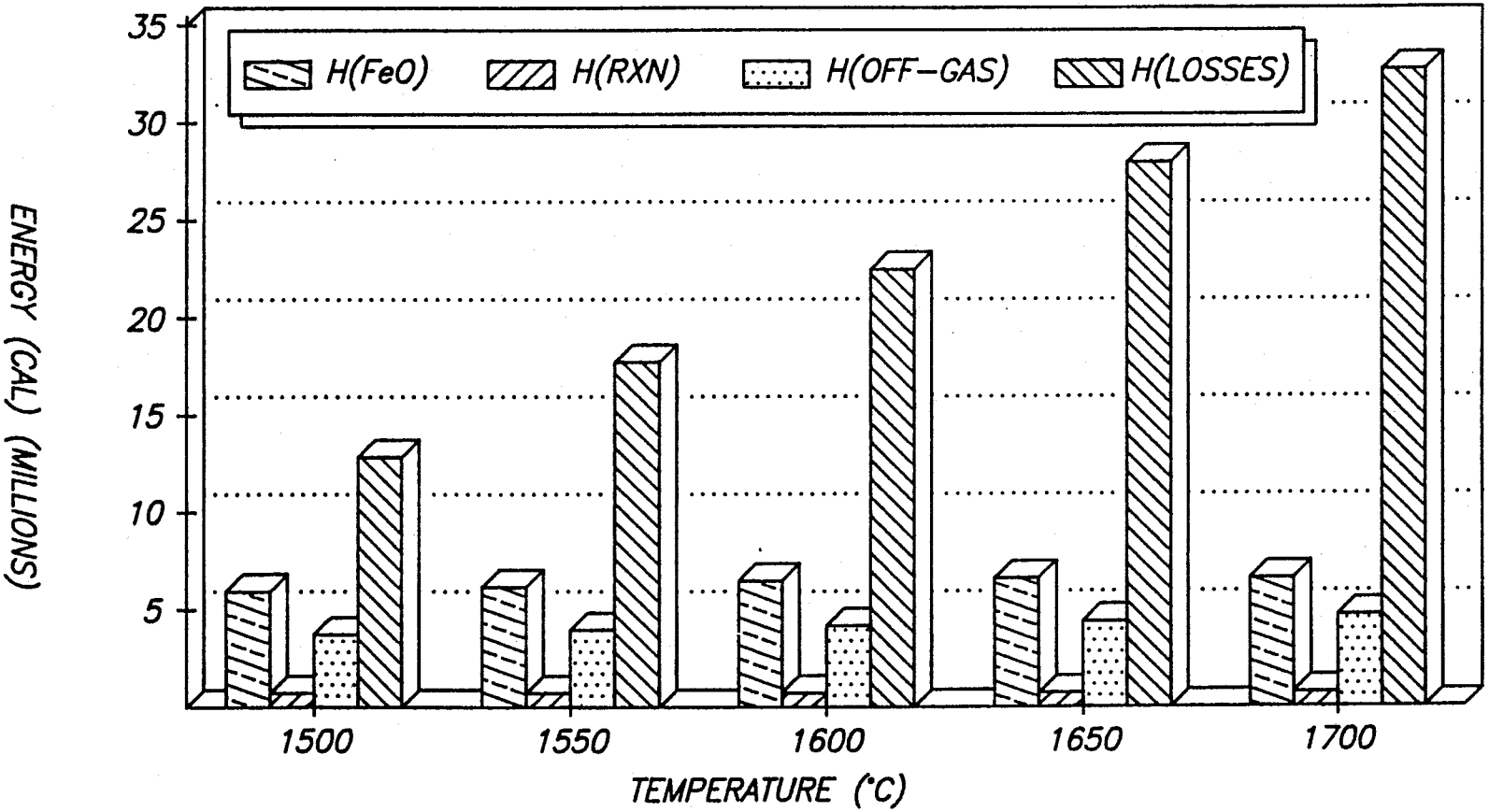
FIG. 7 is a plot of energy balance estimations assuming constant wall temperatures of 1370° C.

The heat loss to the cyclone reactor walls can also be estimated, using basic energy transport equations. The rate of heat loss depends primarily upon the wall heat transfer coefficient, wall emissivity, available surface area, and the wall temperature. These effects are shown in FIG. 7.

REACTOR DESIGN CONSIDERATIONS

Among the reactor design considerations that were evaluated in the development of the cyclone system, were: methods to heat the reactor to high temperatures, reactor size, plasma gas requirements, residence time calculations, time to react, heat and melt, energy requirements, energy and material balances, wall construction, and insulation. A clear plastic model was used in measuring particle flow patterns within the cyclone reactor 11.

REACTOR HEAT UP

Because large amounts of plasma gases are required to heat the cyclone reactor to 1500° C. (1773° K.), a natural gas burner system was designed to provide initial heat up of the reactor system. The burner was shut and plugged and the plasma torch started after heat up. The reactor may also be heated using the plasma system alone.

REACTOR SIZE

The reactor size was chosen based upon the residence time requirements that were calculated for individual particles, the overall energy balance, and the amount of plasma gas required (6–8 scfm) to provide the heat to the system. The test cyclone reactor, diagrammatically shown in FIG. 8, has an inside diameter of 9 inches and an axial length of 2 feet. The lower conical section has an axial length of 4 inches and narrows to an exit diameter of 3 inches. Typical residence times for iron ore particles in the operational reactor were about 1½ seconds.

Once it was determined that it was possible to extend the residence time (through the clear plastic model studies) and that it was possible to use nitrogen in place of helium in plasma torch (2–3 scfm); it was determined that the initial hot cyclone reactor was oversized. The residence time was determined to be one and one half times greater than that calculated to be necessary.

PLASMA GAS REQUIREMENTS

The non-transferred plasma arc torch used in this study (PT50 from Plasma Energy Corporation) requires fixed flow rates of the plasma gases in order to generate the required energy. The flow rates required to achieve 50 kw (50 kj/sec) of power were 2.0 $ft^3$/min (0.05664 $m^3$/min) of argon and 1.0 $ft_3$/min (0.02832 $m^3$/min) of nitrogen.

RESIDENCE TIME CALCULATIONS

All of the preliminary residence time calculations assumed plug flow. These estimates were improved by the clear plastic model study. Due to the formation of a liquid wustite phase in the reactor, the residence time may approach that of a falling film reactor, which would extend the residence time; but the host and mass transfer rates may be decreased drastically.

ENERGY AND MATERIAL BALANCES

Detailed energy and material balance calculations have been performed and the energy balance calculations have been compared to those obtained from the experiments. Energy losses in the various sections of the cyclone reactor 11 have been within expected ranges.

WALL CONSTRUCTION AND INSULATION

The original design called for the formation of wustite skull on the reactor wall to protect it from interaction with the liquid product. This would have required maintaining the inner wall temperature somewhat below 1378° C. (1651° K.), using a thin refractory, water cooled wall. Energy losses through the walls, under these conditions, are too large and an inhibitively large taconite flow rate would be required to obtain a skull of any appreciable thickness. The current graphite wall design in an experimental cyclone reactor allows the walls to reach temperatures near the gas temperature. The graphite inner wall is insulated with graphite felt. The reactor has a water cooled shell. However, graphite is reactive with iron. A suitable non-reactive refractory material should be selected for more permanent installations.

CLEAR MODEL STUDIES

The flow patterns in conventional open gas-solid cyclones have been studied and modeled in detail. These cyclones have a gas discharge at the top that may carry out some of the fine particles. The cyclone used in this study is closed and all of the material discharges out of the bottom. There have been very few fundamental flow studies performed on closed cyclones. The clear model studies were performed to provide fundamental information on the flow of the gases and solids in a closed cyclone of the same size and shape as planned for the hot cyclone.

The clear plastic model was used to measure the gas velocity and pressure profiles using a hot wire anemometer. The measured tangential, radial, and axial velocities were recorded and then used to plot the flow fields in the cyclone. The clear model was also used to study the flow pattern of the ore particles using a time frame video camera.

GAS VELOCITY DISTRIBUTIONS

The measured tangential gas velocity distribution along the radial coordinate, at several axial positions within the cyclone, was observed to have low velocities near the wall and the center line, with a maximum velocity that shifted, slightly, from the outside-in down the length of the reactor. The maximum tangential velocity was measured near the wall at the top of the cyclone, but then shifted towards the center through much of the length. The minimum tangential velocity was always near the center line.

The axial velocity, at any axial position, increases from the wall towards the center line. The minimum was always near the wall and the maximum near the center. The center line axial velocity increases down the length of the reactor and may provide a short circuit for some of the particles.

GAS FLOW PATTERN

The gas flow pattern in the cyclone is a changing radial spiral pattern with a short circuit in the center of the cyclone. A high velocity spiral surrounds the center line and the low velocity flow region is near the walls.

SOLID FLOW PATTERN

The solids flow pattern has been observed experimentally and an attempt is being made to model the behavior of the solids as they travel down the reactor. The particles enter a turbulent region near the top, but are quickly thrown out towards the walls. The particles travel down the cyclone walls in spirals as they melt. The distance between each spiral is independent of the gas flow rate, but the particles appear to travel faster at higher gas flow rates. The location of the spirals also depends upon the geometry of the discharge cone.

PARTICLE RESIDENCE TIME

The particle residence time, using taconite fines as commercially produced, was measured using a time frame video camera. This value varied almost linearly, ranging from about 1.2 seconds at an air flow rate of 30 CFPM to about 0.6 seconds at an air flow rate of 90 CFPM.

CYCLONE EXPERIMENTS

Figure 8:
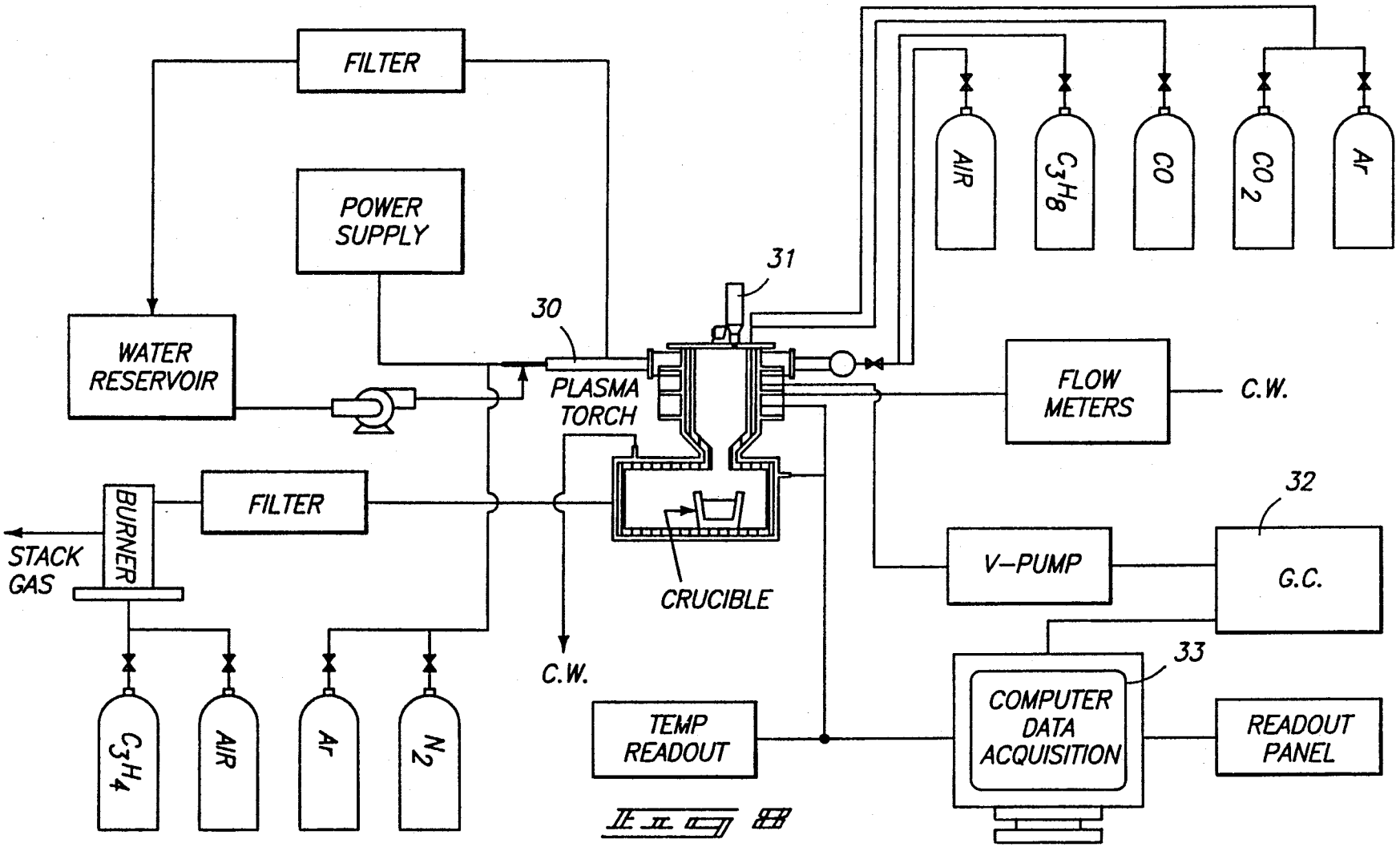
FIG. 8 is a schematic representation of the experimental system.

A schematic of a test hot cyclone system is shown in FIG. 8. The system used a non-transferred arc plasma torch 30 for a heat source. The torch 30 was operated under the standard conditions for the cyclone reactor 11 as given in Table I.

TABLE I

| STANDARD OPERATING CONDITIONS |
|---|
| 240-250-VOLTS, 19-200 AMPS |
| 2.0 $FT^3$/MIN ARGON, 1.0 $FT^3$/MIN NITROGEN |
| 20 VOLUME % CARBON MONOXIDE, |
| 5 VOLUME % CARBON DIOXIDE |
| (Incoming Gaseous Mixture) |
| 50 GRAMS/MINUTE TACONITE |
| POWER: 45-50 KILOWATTS |

Plasma gases were injected tangentially into the cyclone reactor 11. The taconite concentrate powder tested was primarily magnetite, as is shown in Table II.

TABLE II

| LTV STEEL TACONITE SAMPLE ANALYSIS |
|---|
| 67.04% Fe |
| 4.50% Silica |
| 0.20% p |
| (67.68% $Fe_3O_4$ & 25.94% $Fe_2O_3$ calculated) |

The taconite powder was fed axially with a powder feeder 31 using carbon dioxide and argon as the carrier gases. Carbon monoxide was fed, also axially, at the rate determined to allow the development of a known discharge ratio of the partial pressures of carbon monoxide and carbon dioxide. The gas composition was sampled at the discharge and analyzed with a gas chromatograph 32.

Temperatures were measured at three locations inside the reactor. Temperatures and water flow rates were monitored for all the cooling lines. All of the data were collected on a data acquisition system with a computer 33.

The experiments were performed by: (1) Heating the cyclone reactor 11 to a uniform discharge temperature (typically 1500° C. (1773° K.)), (2) Feeding the taconite particles, carbon monoxide, and carbon dioxide into the heated cyclone reactor 11, and (3) Collecting gas, liquid and solid samples from the exit or discharge end of the cyclone reactor 11 for analysis.

Samples collected during study state operation were of primary interest. After cooling, solid samples were collected and subjected to chemical and physical characterization.

An example of our preliminary experimental results is given in Table III.

TABLE III

| OPERATING CONDITIONS AND RESULTS |
|---|
| OPERATING CONDITIONS: |
| CURRENT: 195-197 AMPS. VOLTAGE: 235-250 VOLTS |
| POWER: 45.8-49.3 KILOWATTS |
| Ar TORCH FLOW RATE: 2.1 SCFM. |
| $N_2$ TORCH FLOW RATE: 0.9 SCFM |
| CO FLOW RATE: 0.7 SCRF. |
| Ar CARRIER FLOW RATE: 0.35 SCFM |

TABLE III-continued

| OPERATING CONDITIONS AND RESULTS |
|---|
| TACONITE FEED RATE: 50 GRAMS/MINUTE |
| TOP WALL TEMP: 1550 C. CENTER TEMP: 1675 C. |
| EXIT TEMP: 1425° C. |
| IRON ANALYSIS: |
| INGOT IRON CONTENT: 90.4% Fe |
| FEED IRON CONTENT: 68.4% Fe |

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. An apparatus for iron or ferro-alloy smelting, comprising:

bath smelter means for containing a smelting bath for reductive bath smelting of iron or ferro-alloy ore by coal/oxygen injection through use of endothermic nozzles directed into a smelting bath to form liquid iron or steel;

a closed cyclone reactor having an upper end including an inlet end, said closed cyclone including an open lower exit positioned above the smelting bath within the bath smelter means;

feed means for directing a continuous stream of fine ore particles into the cyclone reactor; and gas supply means for tangentially directing streams of oxygen, with or without air, and a fuel gas selected from the group consisting of producer gas, natural gas and methane for burning within the cyclone reactor to maintain the interior and contents of the cyclone reactor at an elevated temperature;

the equilibrium partial pressure ratio of carbon monoxide to carbon dioxide exiting the cyclone reactor being maintained at a value sufficient to cause the melted ore at the elevated temperatures within the cyclone reactor to be partially reduced during the particulate residence time within the cyclone reactor.

2. The apparatus of claim 1, wherein the cyclone reactor is sized to allow a particle residence time of up to 10 seconds.

3. The apparatus of claim 1, wherein the cyclone reactor is sized to allow an elevated equilibrium temperature within the cyclone reactor in the range of 1300°-1650° C.

4. The apparatus of claim 1, wherein the cyclone reactor is sized to accept particles directed into the cyclone reactor of a size range below 150 microns.

5. The apparatus of claim 1, further comprising:

means operably interconnecting the bath smelter means and the inlet end of the cyclone reactor for directing waste producer gas from the bath smelter means into the interior of the cyclone reactor as the fuel gas.

6. The apparatus of claim 1 wherein the cyclone reactor includes an insulated inner wall for enhancing the thermal efficiency of the cyclone reactor.

7. The apparatus of claim 1 wherein the cyclone reactor includes an inner wall insulated with graphite felt for enhancing the thermal efficiency of the cyclone reactor.

8. A method for smelting iron or ferro-alloy ores, comprising the following steps:

introducing a continuous stream of fine iron or ferro-alloy ore particles into an inlet end of a closed cyclone reactor;

simultaneously directing a burning gaseous mixture tangentially into the cyclone reactor to maintain contents of the cyclone reactor at an elevated temperature, the gaseous mixture comprising oxygen, with or without air, and a reducing fuel gas; selected from the group consisting of producer gas, natural gas and methane performing prereduction, reduction, and melting of the ore particles within the closed cyclone;

directing melted and partially reduced ore from an exit end of the cyclone reactor along with carbon monoxide and carbon dioxide gases;

maintaining the equilibrium partial pressure ratio of carbon monoxide to carbon dioxide exiting the cyclone reactor at a value sufficient to cause the melted ore at the elevated temperatures within the cyclone reactor to be partially reduced during the particulate residence time within the cyclone reactor; and subjecting the resulting melted ore to a bath smelting process to complete reduction of the ore to form liquid iron or steel and a waste producer gas.

9. The method of claim 8, wherein the particle residence time is up to 10 seconds.

10. The method of claim 8, wherein the elevated equilibrium temperatures within the cyclone reactor are in the range of 1300°–1650° C.

11. The method of claim 8, wherein the particles directed into the cyclone reactor have a size range below 150 microns.

12. The method of claim 8, wherein the exit end is conically narrowed relative to an upper end of the cyclone and the melted ore is dropped by gravity from the exit end of the cyclone reactor to a bath smelter.

13. The method of claim 8, wherein the bath smelting step utilizes coal for complete reduction of the melted ore to liquid iron or steel.

14. The method of claim 8, wherein the reducing fuel gas is the waste producer gas from the bath smelting process.

15. A method for smelting iron or ferro-alloy ores, comprising the following steps:

introducing a continuous stream of fine iron or ferro-alloy ore particles into an inlet end of a closed cyclone reactor having an upper end and a bottom end, wherein all particles are discharged out of the bottom end of the cyclone;

simultaneously directing a burning gaseous mixture tangentially into the cyclone reactor to maintain contents of the cyclone reactor at an elevated temperature, the gaseous mixture comprising oxygen, with or without air, and a reducing fuel gas; selected from the group consiting of producer gas, natural gas and methane creating and maintaining a vortical flow within the cyclone to extend residence time of the particles within the cyclone to facilitate prereduction, reduction, and melting of the ore particles within the cyclone, the vortical flow providing a maximum tangential velocity near the top end of the cyclone to create turbulence and prolong residence time of the ore particles within the cyclone;

directing melted and partially reduced ore toward a conically narrowed exit end of the cyclone reactor along with exhaust gases containing both carbon monoxide and carbon dioxide;

maintaining the equilibrium partial pressure ratio of carbon monoxide to carbon dioxide exiting the cyclone reactor at a value sufficient to cause the melted ore at the elevated temperatures within the cyclone reactor to be partially reduced during the particulate residence time within the cyclone reactor; and introducing the resulting melted ore into a bath smelting process to complete reduction of the ore to form liquid iron or steel and a waste producer gas.

* * * * *